United States Patent [19]

Miller

[11] 4,136,506

[45] Jan. 30, 1979

[54] SADDLE PAD

[75] Inventor: Jacob Miller, Santa Barbara, Calif.

[73] Assignee: Miller Harness Company, New York, N.Y.

[21] Appl. No.: 711,466

[22] Filed: Aug. 4, 1976

[51] Int. Cl.[2] ..... B68C 1/12

[52] U.S. Cl. ..... 54/66

[58] Field of Search ..... 54/66, 68, 44, 46, 65

[56] References Cited

U.S. PATENT DOCUMENTS

| | | | |
|---|---|---|---|
| 5,872 | 10/1848 | Calwell | 54/44 |
| 40,128 | 9/1863 | Spencer | 54/46 |
| 270,142 | 1/1883 | Spencer | 54/44 |

FOREIGN PATENT DOCUMENTS

| | | | |
|---|---|---|---|
| 390,677 | 4/1933 | United Kingdom | 54/66 |

*Primary Examiner*—Hugh R. Chamblee

*Attorney, Agent, or Firm*—Lerner, David, Littenberg & Samuel

[57] ABSTRACT

A saddle pad for use in connection with riding saddles is disclosed, including a base portion, a pair of side panels depending from the base portion, each of the side panels including an outer layer and an inner layer, and slot means in said outer layer so that the panel portion of a riding saddle may be inserted into the slot means and between the outer layer of the side panel and the inner layer of the side panel to stabilize the saddle pad during use.

4 Claims, 3 Drawing Figures

SADDLE PAD

FIELD OF THE INVENTION

The present invention relates to saddle pads, particularly for use in connection with riding saddles. More specifically, the present invention relates to double faced saddle pads, including depending panels having an outer layer and an inner layer.

BACKGROUND OF THE INVENTION

In connection with both riding saddles and harnesses, various types of pads have been employed in the past, principally in order to protect the back of the animal, or horse, during use of the saddle or harness. In connection with saddle pads used with riding saddles, the use of these pads is particularly important in protecting the horse's back, particularly since a ridge of considerable weight is involved in such usage.

The use of such saddle pads in connection with riding saddles has also included the use of double-faced saddle pads, or that is, saddle pads including depending side panels which include an outer layer and an inner layer, for double protection with respect to the horse's back.

The use of such devices has been known for many years. Thus, U.S. Pat. No. 97,295 teaches a saddle pad including depending side panels which are fastened to a spring c which permits the loop to stretch and accommodate a saddle strap therethrough. In addition, U.S. Pat. No. 351,212 discloses a saddle pad for use in connection with a harness, which includes attaching straps secured to the lower end of the depending panels of the saddle pad. This patent also discloses the use of flexible materials in the pad itself in order to prevent galling.

Furthermore, Austrian Pat. No. 80313 shows a saddle pad which includes a pair of straps b on the outer surface of the depending panels thereof. Finally, British Pat. No. 262,995 discloses a lady's equestrian saddle which includes an improved numnah having a girth strap secured to the animal's back therefrom.

While each of these saddle pads has provided means by which the pad may be utilized in connection with riding saddles and the like, the search has continued for a simple and efficient pad which can be easily maintained in position to accomplish its basic purposes.

SUMMARY OF THE INVENTION

In accordance with the present invention, it has now been discovered that these and other objects can be accomplished by providing a saddle pad for use in connection with riding saddles which include a depending panel portion thereon, said saddle pad including an upper portion, a pair of side panels depending from the upper portion, each of the side panels comprising an outer layer and an inner layer, and slot means in the outer layer of the side panels, so that the panel portion of the saddle may be inserted into the slot means, and thus between the outer layer of the side panel and the inner layer of the side panel, to thereby stabilize both the saddle pad and the saddle during use.

In this manner, the saddle pad is kept in place during use, and does not slip about, as has been the case in connection with the prior art saddle pads, particularly where straps and the like have been utilized in attempts to keep the saddle pad in position with respect to the saddle itself. In addition, the saddle pad also serves the purpose of absorbing sweat from the horse, and keeping the saddle clean and free therefrom during use.

In a preferred embodiment, the saddle pad is prepared from various materials to provide a soft and comfortable support for the saddle itself. These materials preferably comprise synthetic sheepskin fleece, or various other cloth materials, such as linen, cotton, wools, etc.

In a preferred embodiment, the slot means are disposed on both sides of the saddle pad, that is in connection with both of the depending side panels, to firmly stabilize the saddle pad in respect to the riding saddle during use and preferably extend substantially across the entire width of each such side panel.

BRIEF DESCRIPTION OF THE DRAWINGS

The present invention may be further understood with respect to the following drawings, wherein.

DETAILED DESCRIPTION

Figure 1:
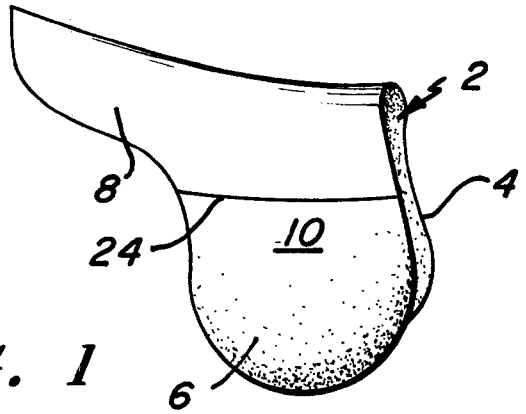
FIG. 1 is an elevational side view of a saddle pad in accordance with the present invention.

Referring to the figures, in which like numerals refer to like portions thereof, FIG. 1 shows saddle pad 2 of the present invention (including an upper portion 8) which will be in direct contact with the lower portion of the saddle. Depending from both sides of the upper portion 8 of the saddle pad are panel portions 4 and 6, so that during use, these panel portions 4 and 6 depend on both sides of the horse's back.

Figure 2:
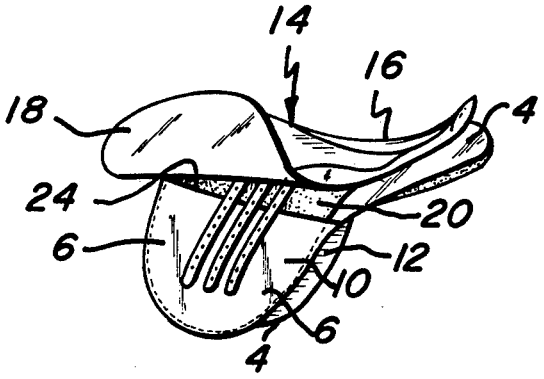
FIG. 2 is an elevational side view of a saddle pad in accordance with the present invention in conjunction with a saddle.
Figure 3:
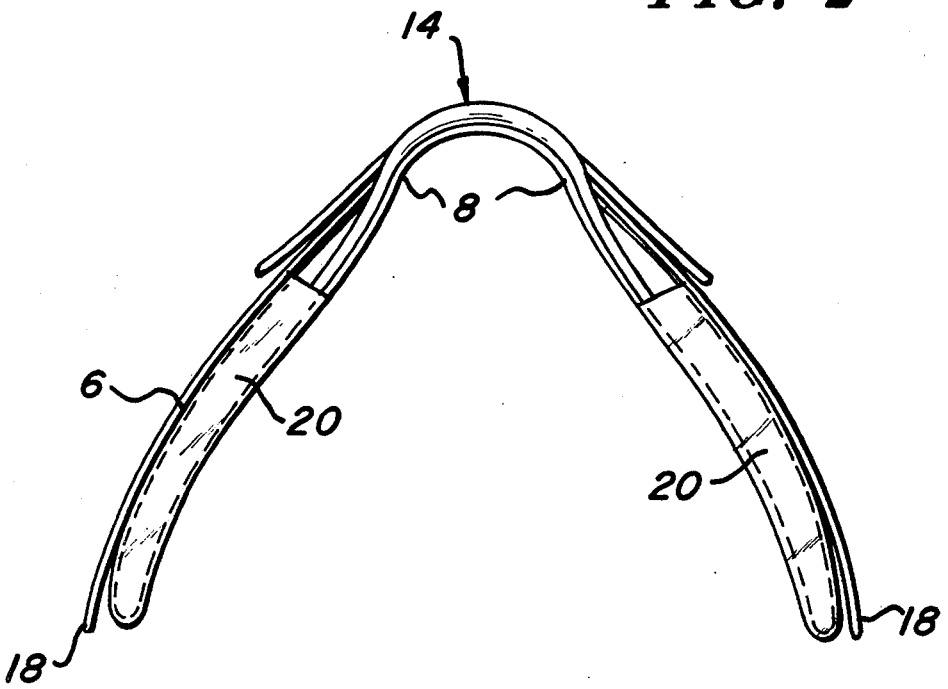
FIG. 3 is a front, elevational view of the saddle pad of the present invention in use in connection with a saddle.

As can best be seen in FIG. 2, each of the depending panels 4 and 6 include both an outer portion 10, which faces away from the horse's back and contacts the riding saddle itself, and an inner portion 12, which corresponds to the outer portion 10, but faces inwardly, contacting the horse's back during use.

The overall saddle pad itself, including depending side panels 4 and 6, is generally prepared from a material capable of providing soft and comfortable protection from the saddle during use. These materials thus include synthetic sheepskin and various other cloths, such as linen, cotton, wool, etc. In addition, however, it is also possible to prepare these saddle pads from a variety of plastic and/or cellulosic materials. The ultimate selection of these materials will thus be a matter of comfort and economics, and portions of the pad may be prepared utilizing various selected materials.

As can best be seen in FIG. 2, a saddle, in this case an English saddle 14, is generally used in connection with the saddle pad of the invention. The rider will thus sit on the seat portion 16 of the saddle 14. The flap portions 18 generally depend from the seat portion 16, and the side of the horse is generally separated from the rider's leg by means of both the saddle flap portion 18 as well as by means of the depending panels 4 and 6 of the saddle pad of this invention. In addition, however, the saddle 14 includes a depending panel 20. As shown in FIG. 2, the outer portion of the depending side panels 4 and 6 include a slot 24 extending from one edge of the depending side panels 4 and 6, across their entire width, to the other edges thereof. The slot thus provides access between the outer depending panel 10 and the inner depending panel 12, thus forming a pocket therebetween. The saddle panel 20 may thus be inserted directly into this pocket between the outer depending panel 10 and the inner depending panel 12, through slot 24. In this manner the saddle pad is stabilized with respect to the saddle 14 during use of the saddle. Preferably, the slot 24 will extend substantially across the entire width of the outer depending panel.

What is claimed is:

1. A saddle pad for use in connection with riding saddles including depending panel portions extending downwardly on either side of the tree of the saddle, said saddle pad comprising an upper portion contoured to receive the seat portion of said saddle, and a pair of side panels depending downwardly from said upper portion, each of said side panels comprising an outer layer and an inner layer to define a pocket therebetween, and slot means associated with said outer layer of said side panels, so that substantially the entire saddle panel portions below the saddle tree may be inserted into said slot means, and into said pocket between said outer layer of said side panels and said inner layer of said side panels, to thereby stabilize said saddle pad during use.

2. The saddle pad of claim 1 wherein said saddle pad comprises cloth.

3. The saddle pad of claim 2 wherein said cloth is selected from the group consisting of synthetic sheepskin fleece, linen, cotton and wool.

4. The saddle pad of claim 1 wherein said slot means extends substantially across the entire width of said outer layer of said side panel.

* * * * *